US006805722B2

(12) United States Patent
Hunt et al.

(10) Patent No.: US 6,805,722 B2
(45) Date of Patent: Oct. 19, 2004

(54) APPARATUS AND METHOD FOR FORMING A SPIRAL WOUND ABRASIVE ARTICLE, AND THE RESULTING ARTICLE

(75) Inventors: Douglas C. Hunt, Miltona, MN (US); Ann M. Hawkins, Lake Elmo, MN (US); Gary L. Heacox, Zimmerman, MN (US); Robert A. Follensbee, Oakdale, MN (US); Stephen J. Yoos, Andover, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/262,611

(22) Filed: Oct. 1, 2002

(65) Prior Publication Data

US 2004/0072509 A1 Apr. 15, 2004

(51) Int. Cl.[7] ..... B24D 18/00; B24D 9/00; B24D 11/00

(52) U.S. Cl. ..... 51/298; 51/295; 51/297; 51/307; 51/308; 51/309; 51/293

(58) Field of Search ..... 51/293, 295, 297, 51/298, 307, 308, 309; 451/296, 531, 535

(56) References Cited

U.S. PATENT DOCUMENTS

| | | | | |
|---|---|---|---|---|
| 2,189,733 | A | 2/1940 | Kistler et al. | 51/280 |
| 2,189,754 | A | 2/1940 | Cherrington | 51/188 |
| 2,682,733 | A | 7/1954 | Buckner | 51/188 |
| 2,743,559 | A | 5/1956 | Ball et al. | 51/188 |
| 3,972,468 | A | 8/1976 | Reid | 229/51 BP |
| 3,982,686 | A | 9/1976 | Parlour et al. | 229/51 BP |
| 4,018,574 | A | 4/1977 | Dyer | 51/295 |
| 4,039,303 | A | 8/1977 | Yasushi et al. | 51/297 |
| 4,751,138 | A | 6/1988 | Tumey et al. | 428/323 |
| 5,417,726 | A | 5/1995 | Stout et al. | 51/293 |
| 5,436,063 | A | 7/1995 | Follett et al. | 428/224 |
| 5,529,590 | A | 6/1996 | Ennis et al. | 51/298 |
| 5,700,188 | A | 12/1997 | Uhlmann et al. | 451/532 |
| 5,863,847 | A | 1/1999 | De Voe et al. | 442/151 |

FOREIGN PATENT DOCUMENTS

| | | |
|---|---|---|
| CH | 390 717 | 8/1965 |
| DE | 25 20 297 | 5/1975 |
| EP | 0 497 451 A2 | 8/1992 |
| EP | 0 497 451 A3 | 8/1992 |
| EP | 0 626 238 A1 | 11/1994 |
| WO | WO 97/07936 | 3/1997 |
| WO | WO 01/98032 | * 12/2001 |

* cited by examiner

*Primary Examiner*—Michael Marcheschi
(74) *Attorney, Agent, or Firm*—Rick L. Franzen

(57) ABSTRACT

An apparatus and method for forming an endless spiral wound abrasive article and the resulting article. The apparatus includes first and second spaced-apart hubs, configured so that a portion of first and second webs passing between the first hub and the second hub is oriented substantially in a plane which remains stationery even if a position of a hub is changed. The apparatus further includes winders and a web joiner. The method includes providing a second web which includes an adhesive disposed on a first surface and a liner releasably affixed to the adhesive. The method includes removing the liner from the second web before positioning the second web adjacent the first web. The first and second webs are wound about the first and second hubs to form a spiral wound article having a desired circumference.

20 Claims, 10 Drawing Sheets

APPARATUS AND METHOD FOR FORMING A SPIRAL WOUND ABRASIVE ARTICLE, AND THE RESULTING ARTICLE

BACKGROUND OF THE INVENTION

Endless coated abrasive articles, such as belts, sleeves and tubes are used in a variety of abrading operations, especially in the woodworking and metal finishing industries. These operations typically require that the articles be made and supplied by the coated abrasive manufacturer in a large variety of widths and circumferences.

Techniques for making endless coated abrasive belts are known in the art and include those utilizing lap joints and butt splices. Lap joints can be provided, for example, by cutting a coated abrasive material into an elongate strip of a desired width and length. The two free ends of the elongate strip are respectively beveled to have a top end and a bottom end which can be superposed to form a joint. The beveled ends are then overlapped and joined adhesively or mechanically. Butt splices can be provided, for example, by mating the two free ends of the elongate strip into a juxtaposed relationship at a juncture line. The bottom surface of the backing at each end of the elongate strip is then coated with an adhesive, mechanically secured, or otherwise attached, and may be overlaid with a strong, thin, tear-resistant, splicing media in the joint area. The endless coated abrasive belt may, for example, be subsequently slit into narrower widths.

Coated abrasive belts in widths greater than the width of the coated abrasive material have been produced by a number of methods. One such method involves piecing together segments of coated abrasive material to form wide, multi-jointed sectional belts that cover a broad range of belt widths and belt circumferences. These belts, however, have the drawback of increased cost due to the multiple piecing and joining processes required to fabricate the belts. In addition, multiple joints increase the potential for problems due to weakening of the belt at the joints, as well as process control and quality issues.

Another method of forming an endless coated abrasive belt that has a width greater than the width of coated abrasive material from which it was made involves spiral winding of material. A conventional method for making such "spiral wound" belts involves winding an inner liner spirally on a mandrel having an outer circumference equal to the inside circumference of the desired abrasive belt, applying an adhesive to the outer major surface of the inner liner, and winding spirally over the adhesive layer a strip of coated abrasive material. Such a method is widely used for the fabrication of belts in smaller sizes, up to, for example, 6 inches (15.2 cm) in diameter or 19 inches (48.3 cm) in circumference.

Another such method involves spiral winding narrow strips of coated abrasive material having scarfed (or angle cut) edges that overlap and are adhered using conventional techniques. Also, the edges of a piece of wider coated abrasive material may be formed to abut when wound spirally within a revolvable drum. Subsequently, a resinous coating material is applied to the inner periphery of the belt which then spreads, as the drum revolves, to form a continuous layer of resinous coating that joins the belt material together. Yet another method involves spiral winding about a mandrel a coated abrasive material with abutting edges that has a flexible backing material including a layer of hot-melt adhesive. The spiral wound material is then heated to cause the hot-melt adhesive to flow across the abutted edges, resulting in a continuous layer that secures the edges together.

An ongoing need exists for spiral wound abrasive belts that are produced in a faster, cheaper and more efficient manner, and in a variety of sizes. Such spiral wound belts that take advantage of abrasive media constructions that produce stronger and more durable abrasive articles are also desirable.

BRIEF SUMMARY OF THE INVENTION

Aspects of the present invention include an apparatus and method for forming an endless spiral wound abrasive article and the resulting article. The apparatus includes first and second spaced-apart hubs, configured so that a portion of first and second webs passing between the first hub and the second hub is oriented substantially in a plane which remains stationery even if a position of one of the hubs is changed. The apparatus further includes winders and a web joiner. The method includes providing a second web which includes an adhesive disposed on a first major surface and a liner releasably affixed to the adhesive. The method includes removing the liner from the second web before positioning the second web adjacent the first web. The first and second webs are wound about the first and second hubs to form a spiral wound article having a desired circumference.

While the above-identified drawings set forth several embodiments of the present invention, other embodiments of the present invention are also contemplated, as noted in the discussion. This disclosure presents illustrative embodiments of the present invention by the way of representation and not limitation. These representations are not to scale. Numerous other modifications and embodiments can be devised by those skilled in the art which fall within scope and spirit of the principles of this invention.

DETAILED DESCRIPTION

Figure 1:
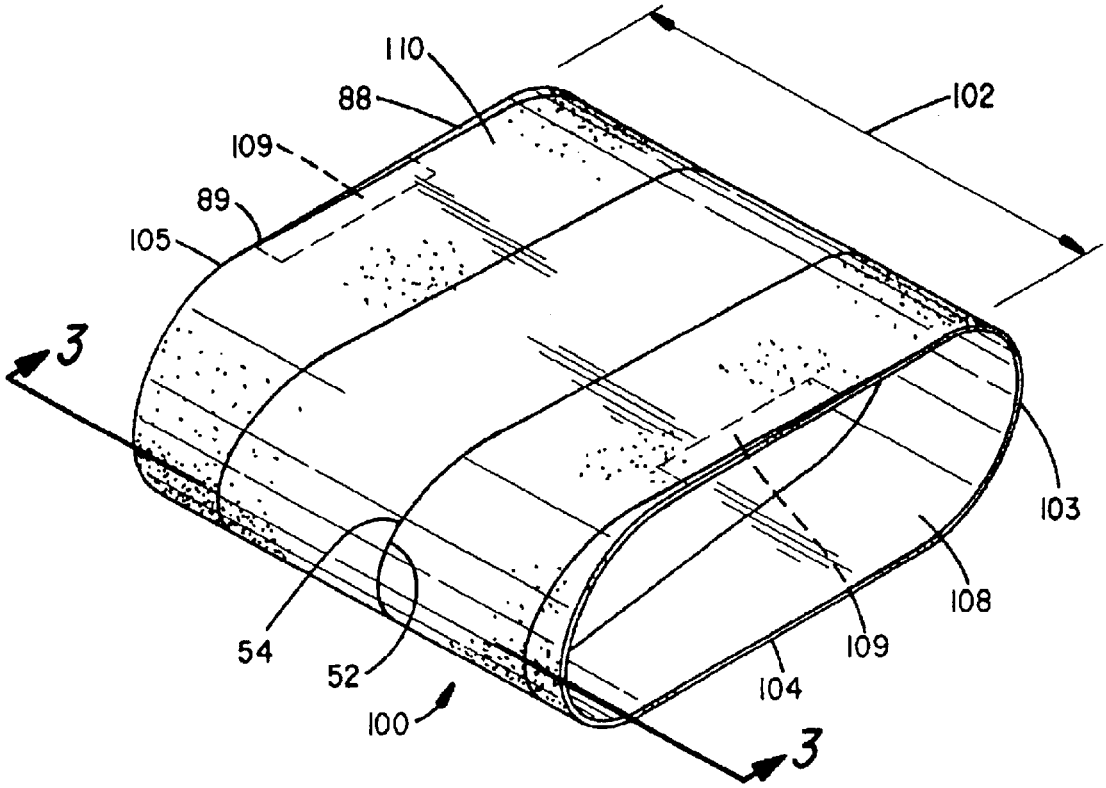
FIG. 1 is a perspective view of one embodiment of a spiral wound abrasive belt formed in accordance with the present invention.

With reference to the attached drawings, it is to be understood that like components are labeled with like numerals throughout the several drawings. FIG. 1 is a spiral abrasive belt 100 formed in accordance with the present invention for use on a polisher, sander, grinder or other rotating machine. The spiral belt 100 has a width 102 and a circumference 103. The spiral belt 100 also has first and second belt ends 104 and 105, respectively, an inner major surface 108 and an outer major surface 110. The inner and outer major surfaces 108, 110 are in some embodiments preferably continuous such that there is no appreciable beginning or end to the belt 100 while it rotates over a surface being processed.

Figure 2:
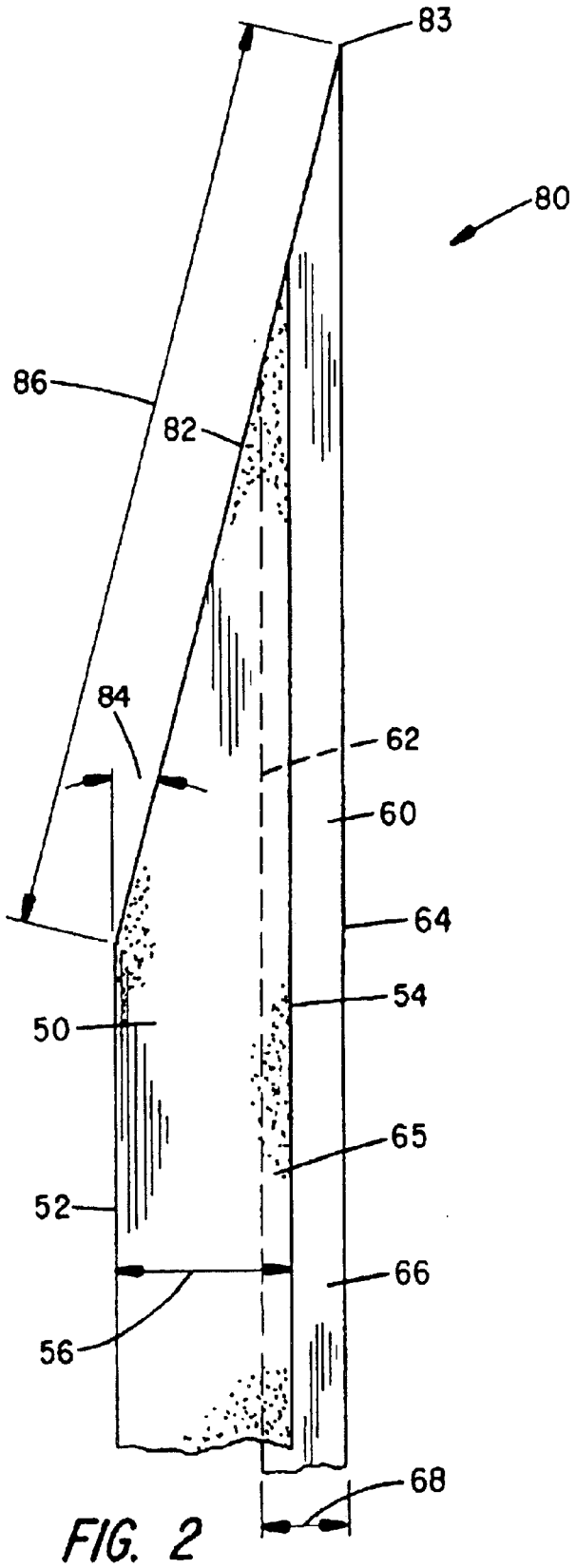
FIG. 2 is a plan view of an abrasive media including two webs for use in the formation of the spiral wound abrasive belt of FIG. 1.

FIG. 2 is an abrasive media 80 that may be used to form the spiral belt 100, in accordance with the present invention. The abrasive media 80 includes a first web 50 having a width 56 and first and second side edges 52, 54. In some embodiments, first and second side edges 52, 54 are preferably parallel to one another. As shown, the abrasive media 80 also includes a second web 60 that has a width 68 and parallel first and second side edges 62 and 64, respectively. The first web 50 overlaps a first portion 65 of the second web 60 along the length leaving a second portion 66 of the second web 60 exposed. As shown, the second portion 66 is sized to about one-half the width 68 of the second web, although it may be smaller or larger if desired.

The abrasive media 80 has a first end 82 formed or cut at an angle 84 to the web side edges 52, 54, 62, 64. The angle 84 and thus the length 86 of the first end 82 may vary depending on the desired dimensions of the spiral belt 100. In one embodiment, the first end length 86 determines the circumference 103 of the spiral belt 100, so that changes in angle 84 and length 86 will provide larger or smaller belts as desired for a particular application. In another embodiment, a pre-cut angled edge 84 is not needed. The resulting spiral belt 100 may be trimmed as needed to provide an even first belt end 104. In this embodiment, the angle of winding and width 56 of the first web 50 (as discussed in more detail below) determine the resulting circumference 103 of the spiral belt 100.

The abrasive media 80 may be configured as a continuous web, thereby forming a spiral belt 100 of ever increasing width, which may then be slit to a desired belt width 102. The abrasive media 80 may also be configured to include a second end 88, as shown in FIG. 1, formed parallel to the first end 82, giving the abrasive media 80 a fixed length (not shown). The length of the abrasive media 80 then determines the width 102 of the spiral belt 100.

The spiral belt 100 is formed by winding the abrasive media 80 in a spiral wherein side edge 52 is brought into abutting contact with side edge 54, such that no apparent or appreciable gap is present. In some embodiments, any gap is preferably less than about 1/32 inch (0.08 cm) wide. The angle 84 sets the angle of wrap for the spiral belt 100. The angled first end 82 provides a starting point at first tip 83 for the spiral belt 100, as well as the relatively even first belt end 104. In a like manner, the angled second end 88 provides an end point at tip 89 for the spiral belt 100 and second belt end 105 that is also relatively even. The resulting spiral belt 100 has width 102. In some embodiments, the first and second belt ends 104, 105 are both configured to be generally perpendicular to the width dimension 102 and generally parallel to each other. For continuous width belts, the second belt end 105 may be formed by slitting the belt 100 at the desired width 102, instead of by a second end 88. Tabs 109 may be provided to secure the angled first and second end tips 83 and 89 to the remainder of the spiral belt 100.

Figure 3:
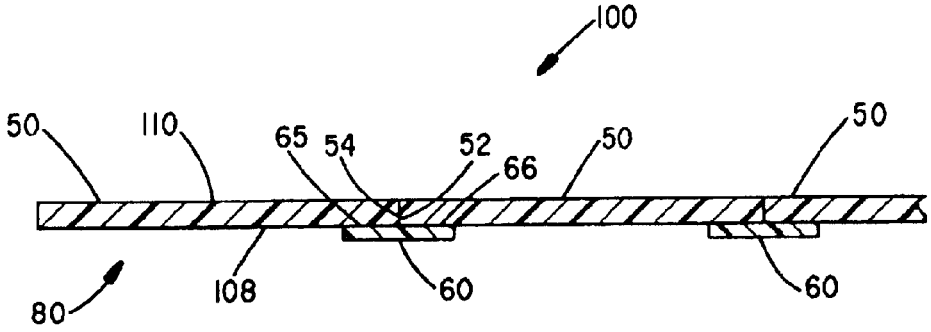
FIG. 3 is a partial cross-sectional view of the spiral wound abrasive belt of FIG. 1.

As the abrasive media 80 winds to form the spiral belt 100, the first web 50 overlaps the exposed second portion 66 of the second web 60. FIG. 3 is a partial cross-sectional view of wound spiral belt 100 showing the resulting relationship between the first and second webs 50 and 60, respectively. In some embodiments, the second web 60 includes an adhesive over the second portion 66, which facilitates joining with the first web 50 during the winding to produce the spiral belt 100.

Figure 4:
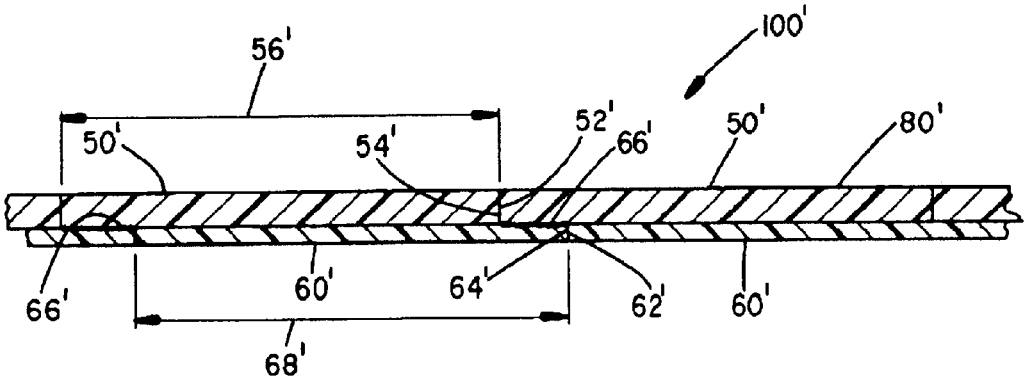
FIG. 4 is partial cross-sectional view of a second embodiment of a spiral wound abrasive belt formed from an abrasive media including three webs.

The second web 60 may be provided as a narrow strip whose width 68 is appreciably narrower than width 56 of the first web 50, as shown in FIGS. 2 and 3, functioning primarily for the purpose of joining the abutting edges 52 and 54 of the first web 50. As shown in FIG. 4 in a second embodiment of a spiral belt 100' formed from an abrasive media 80', a second web 60' may also be provided in a larger width 68' up to and including a width 56' of a first web 50', positioned an offset amount 66' from the first web 50'. As shown, the offset amount 66' is substantially less than one-half the width 68' of the second web 60', however it may be smaller or larger if desired. The second web width 68' should be no greater than the first web width 56' or else first web edges 52' and 54' will not abut, but will have a gap between them. If the edges 52', 54' did abut without a gap, there would be a bump running around belt 100' where the second web 60' overlaps itself. When the second web width 68' is about equal to the first web width 56', the second web side edges 62' and 64' will also abut without an appreciable gap in a manner similar to the side edges 52', 54' of the first web 50'. In some embodiments of the exemplary spiral belt in accordance with the present invention, the second web 60' also includes adhesive over the offset portion 66' (applied to either the first or second webs 50', 60') to facilitate joining of the second web 60' to the first web 50'.

Figure 5:
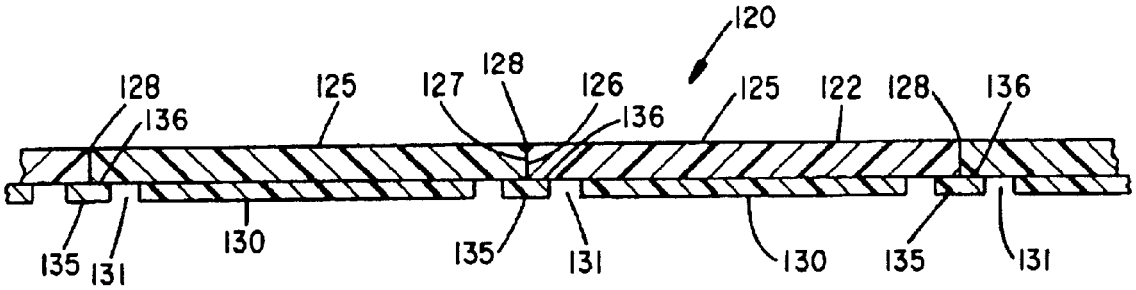
FIG. 5 is a partial cross-sectional view of a third embodiment of a spiral wound abrasive belt formed from an abrasive media including three webs.

Although shown with two webs 50, 60 in FIGS. 1–3, and webs 50' and 60' in FIG. 4, the spiral belt 100, 100' may be formed from more or fewer webs as needed to produce a spiral belt 100, 100' having the desired properties for the particular application. In FIG. 5, a third embodiment of a spiral belt 120, shown in a cross-sectional view, is formed from an abrasive media 122 including three webs: a first web 125, a second web 130 and a third web 135. In this embodiment, the second web 130 is somewhat narrower than the first web 125 such that the second web 130 is undercut from first web edges 126, 127 leaving a gap 131 adjacent the seam 128 where the edges 126, 127 abut. The third web 135 is then positioned within the gap 131, adjacent the first web 125 and offset from one of the edges 126, 127 a portion 136, such that the third web 135 overlaps and joins the seam 128 when the abrasive media 122 is spirally wound into the belt 120. In some embodiments, the second web 130 may be attached to the first web 125 using many methods, including but not limited to adhesive. In some embodiments, the third web 135 preferably includes adhesive at the offset portion 136 (applied to either the first or third webs 125, 135 respectively) to join the seam 128 of the belt 120.

In some embodiments, preferred adhesives include phenolic resins, aminoplast resins, hot melt resins, latex resins, epoxy resins, ethylene acrylic acid resins, polyvinyl acetate resins, radiation curable resins, urethane resins, polyester resins, and pressure sensitive adhesives.

Adhesives in some embodiments are thermosetting resins. The terms "thermosetting" or "thermoset" refer to reactive systems that irreversibly cure upon application of heat and/or other energy sources, such as E-beam, ultraviolet radiation, visible light, etc., or with time upon the addition of a chemical catalyst, moisture, or the like. The term "reactive" includes components that react with each other (or self react) either by polymerizing, cross linking, or both. The components are often referred to as resins. The term "resin" refers to polydisperse systems containing monomers, oligomers, polymers, or combinations thereof.

Phenolic resins may be used because of their thermal properties, availability, cost and ease of handling. There are two types of phenolic resins: resole and novolac. Resole phenolic resins have a molar ratio of formaldehyde to phenol greater than or equal to one to one, typically between 1.5:1.0 to 3.0:1.0. Novolac resins have a molar ratio of formaldehyde to phenol less than one to one.

In some embodiments, suitable phenolic resins include about 70% to about 85% solids, and in some embodiments preferably about 72% to about 82% solids. In some embodiments, the remainder of the phenolic resin is preferably water with substantially no organic solvent. If the percent solids is very low, more energy is required to remove the water and/or solvent. If the percent solids is very high, the viscosity of the resulting phenolic resin is too high, which may lead to processing problems.

Examples of commercially available phenolic resins include those available under the trade designations "VARCUM" and "DUREZ" from Occidental Chemical Corp., Dallas, Tex.; "AROFENE" and "AROTAP" from Ashland Chemical Company, Columbus, Ohio; "RESINOX" from Monsanto, St. Louis, Mo.; and "BAKELITE" from Bakelite AG, Iserlohn, Germany.

Modified phenolic resins may also be used. For example, a plasticizer, latex resin, or reactive diluent may be added to a phenolic resin to modify flexibility and/or hardness of the cured phenolic binder.

A suitable aminoplast resin has at least one pendant $\alpha,\beta$-unsaturated carbonyl group per molecule. These unsaturated carbonyl groups may be acrylate, methacrylate or acrylamide type groups. Examples of such materials include N-hydroxymethyl-acrylamide; N,N'-oxydimethylenebisacrylamide; ortho and para acrylamidomethylated phenol; acrylamidomethylated phenolic novolac and combinations thereof.

Suitable epoxide resins include monomeric epoxy resins and polymeric epoxy resins. These resins can vary greatly in the nature of their backbones and substituent groups. Examples of epoxy resins include 2,2-bis[4(2,3-epoxypropoxyphenol)propane (diglycidyl ether of bisphenol A)] and commercially available materials under the trade designations "EPON 828," "EPON 1004," and "EPON 1001F," available from Shell Chemical Co., Houston, Tex.; and "DER-331," "DER-332," and "DER-334," all available from Dow Chemical Co., Midland, Mich. Other suitable epoxy resins include glycidyl ethers of phenol formaldehyde novolac (e.g., "DEN-431" and "DEN-438" available from Dow Chemical Co., Midland, Mich.). Other epoxy resins include those described in U.S. Pat. No. 4,751,138 (Tumey, et al.), incorporated herein by reference.

Other suitable adhesives include waterborne acrylic polymers or copolymers, commercially available under the trade designation "NEOCRYL;" urethane-acrylic copolymers, commercially available under the trade designation "NEOPAC;" and polyurethane resins, commercially available under the trade designation "NEOREZ," all available from Neoresins, Inc., Wilmington, Mass.; and acrylic and acrylonitrile latex resins, commercially available under the trade designation "HYCAR," available from Noveon, Inc., Cleveland, Ohio. Still other suitable adhesives include acrylated acrylic or acrylated urethane polymer resins, commercially available under the trade designation "NEORAD," available from Neoresins, Inc., Wilmington, Mass.; acrylated polyester resins, commercially available from UCB Chemical Corp., Smyrna, Ga., and butadiene and butadiene styrene resins.

Further suitable adhesives include a 100% solids blend of vinyl ether monomers and oligomers. Such resins are typically low molecular weight materials which form films by crosslinking upon exposure to UV radiation. Examples of commercially available blends include "RAPICURE" from ISP, Wayne, N.J.; and "VECTOMER" from Reilly Industries, Greensboro, N.C. A catalyst is typically required to initiate crosslinking. A suitable catalyst such as UVI-6990 (a cationic photocatalyst) commercially available under the trade designation "CYRACURE" from Dow Chemical, Midland, Mich., may be used.

Suitable urea-aldehyde resins include any urea derivatives and any aldehydes which are capable of being rendered coatable and have the capability of reacting together at an accelerated rate in the presence of a catalyst, such as a cocatalyst.

Acrylate resins include both monomeric and polymeric compounds that contain atoms of carbon, hydrogen and oxygen, and optionally, nitrogen and halogens. Oxygen or nitrogen atoms or both are generally present in ether, ester, urethane, amide, and urea groups. Representative examples of acrylate resins include methylacrylate, ethylacrylate, methyl methacrylate, ethyl methacrylate, ethylene glycol diacrylate, ethylene glycol dimethacrylate, hexanediol diacrylate, triethylene glycol diacrylate, trimethylolpropane triacrylate, glycerol triacrlate, pentaerythritol triacrylate, pentaerythritol trimethacrylate, pentaerythritol tetraacrylate and pentaerythritol tetramethacrylate.

A hot melt resin may also be used. Exemplary hot melt resins are described in U.S. Pat. No. 5,436,063 (Follett, et al.), incorporated herein by reference. Hot melt resins include compositions that are solid at room temperature (about 20°–22° C.) but which, upon heating, melt to a viscous liquid that can be readily applied to a backing. Useful hot melt resins include thermoplastics such as polyolefins, polyesters, nylons and acrylics, for example, a Zn-modified ethylene/methacrylic acid copolymer available from E.I. DuPont & Company of Wilmington, Del., under the tradename "SURLYN."

Other hot melt resins may include blends of thermoplastic resins with thermosetting resins. Thermoplastic resins are typically supplied as pellets and must be melted, pumped and extruded in hot form as a sheet or film. The film can be applied directly to backings with non-contact equipment (drop or extrusion dies, for example) or with contact equipment (ROC or rotating rod dies). The extruded coating can be solidified by cooling or it can be crosslinked with ultraviolet (UV) energy if radiation curable components are present in the hot melt resin. It is also possible to provide the hot melt resins as uncured, unsupported rolls of adhesive film. In this instance, the resin is extruded, cast, or coated to form the film. Such films are useful in transfer coating the resin to a backing.

Figure 6:
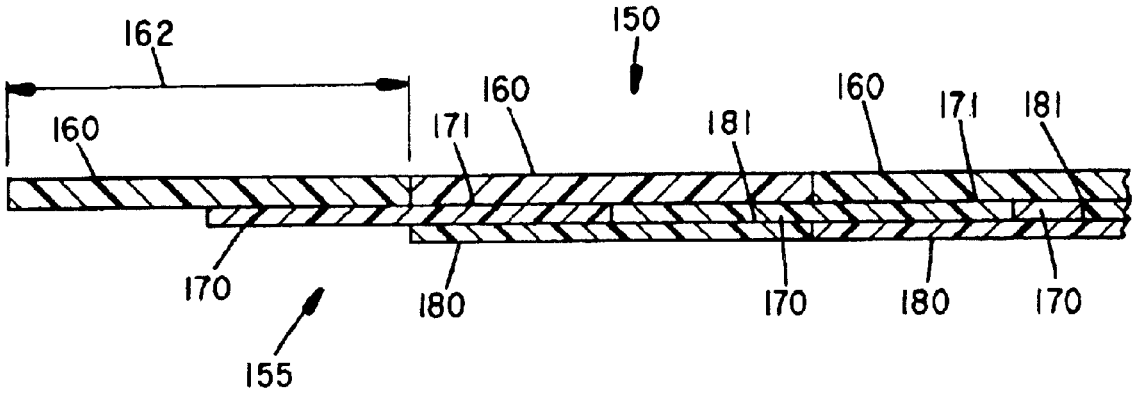
FIG. 6 is a partial cross-sectional view of a fourth embodiment of a spiral wound abrasive belt formed from an abrasive media including three webs.

FIG. 6 is a partial cross-sectional view of a fourth embodiment of a spiral belt 150 formed from a spiral wound abrasive media 155 having three overlapped webs: an outermost web 160, a middle web 170 and an innermost web 180. Each web 160, 170, 180 is shown to be about equal in width 162, with each web 160, 170, 180 offset from the adjacent web or webs about one-half the width 162. As a result, the middle web 170 has a one-half width exposed portion 171 and the innermost web 180 has a one-half width exposed portion 181. As the abrasive media 155 winds to form the spiral belt 150, the first web 160 overlaps the exposed portion 171 of the middle web 170, and the middle web 170 overlaps the exposed portion 181 of the innermost web 180, such that each web 160, 170, 180 produces abutting joints with no appreciable gap. Although four embodiments have been shown and described, it is to be understood that other web configurations for the abrasive media are possible and within the contemplation and scope of the present invention. In addition, although adhesive is described with reference to some embodiments as preferred for attachment of the overlapped webs, it is to be understood that other forms of attachment may also be used and are within the scope of the present invention.

As shown, in some embodiments the abrasive media 80, 80', 122 and 155 are preferably configured as a plurality of webs positioned in an adjacent and overlapping manner with respect to each other. In some embodiments, the first or outermost webs 50, 50', 125, 160 are preferably coated abrasives formed from one or more layers of material and one or more layers of abrasive particles. Coated abrasives generally comprise a flexible backing upon which a binder supports a coating of abrasive particles. The abrasive particles are typically secured to the backing by a first binder, commonly referred to as a make coat. Additionally, the abrasive particles are generally oriented with their longest dimension perpendicular to the backing to provide an optimum cut rate. A second binder, commonly referred to as a size coat, is then applied over the make coat and the abrasive particles to further anchor the particles to the backing so as the reduce the likelihood of abrasive particles fracturing off during use. In some embodiments, a backing is preferably coated with iron seeded sintered sol-gel alumina abrasive particles made according to U.S. Pat. No. 5,611,829 (Monroe et al.), which is incorporated herein by reference, in a phenol-formaldehyde binder and having a phenol-formaldehyde size layer with calcium carbonate as a filler.

Porous cloth, film, fabric and textile materials are frequently used as backings for coated abrasive articles. The make coat precursor is typically applied to the backing as a low viscosity material. In this condition, the make coat precursor can infiltrate into the interstices of the porous backing leaving an insufficient coating thickness making it difficult to bond the subsequently applied abrasive particles to the backing, and on curing, resulting in the backing becoming stiff, hard and brittle. As a result, it has become conventional to employ one or more treatment coats, such as a presize, saturant coat, backsize or a subsize coat, to seal the porous backing. Such treatment coats also allow for the use of less expensive backing materials, such as paper, combined with reinforcing materials, as described below to achieve similar strength and tear resistance as that of more expensive cloth type backings.

The presize, saturant coat, backsize and subsize coat typically involve thermally curable resinous adhesives, such as phenolic resins, epoxy resins, acrylate resins, acrylic lattices, lattices, urethane resins, glue, starch and combinations thereof. A saturant coat saturates the cloth and fills pores, resulting in a less porous, stiffer cloth with more body. An increase in body provides an increase in strength and durability of the article. A presize coat, which is applied to the front side of the backing, may add bulk to the cloth or may improve adhesion of subsequent coatings, or may act as a barrier to excessive make coat penetration. A backsize coat, which is applied to the back side of the backing, i.e., the side opposite that to which the abrasive grains are applied, adds body to the backing and protects the yarns of the cloth from wear. A subsize coat is similar to a saturation coat except that it is applied to a previously treated backing. Paper backings may be treated to decrease or prevent penetration of make adhesives and/or to waterproof.

As described above, a backing may be, for example, a conventional, sealed coated abrasive backing or a porous, non-sealed backing. Such a backing may be comprised of, for example, cloth, vulcanized fiber, paper, nonwoven materials, fibrous reinforced thermoplastic backing, polymeric films, substrates containing hooked stems, looped fabrics, metal foils, mesh foam backing, and laminated multilayer combinations thereof. In some embodiments, the backing is preferably a polyester film with a width of about 0.178 meter (7 inches) and a thickness of about 0.00491 inch (125 micrometers). Cloth backings can be untreated, saturated, presized, backsized, porous, or sealed, and they may be woven or stitch bonded. The cloth backings may include fibers or yams of cotton, polyester, rayon, silk, nylon or blends thereof. The cloth backing can be provided as laminates with different backing materials described herein. Paper backings also can be saturated, barrier coated, presized, backsized, untreated, or fiber-reinforced. The paper backings also can be provided as laminates with a different type of backing material. Nonwoven backings include scrims and may be laminated to different backing materials mentioned herein. The nonwovens may be formed of cellulosic fibers, synthetic fibers or blends thereof. Polymeric backings include polyolefin or polyester films, nylon, "SURLYN" copolymer or other materials that may be hot-melt laminated. The polymeric backings can be provided as blown film, or as laminates of different types of polymeric materials, or laminates of polymeric films with a non-polymeric type of backing material. The backing can also be a stem web used alone or incorporating a nonwoven, or as a laminate with a different type of backing. The loop fabric backing can be brushed nylon, brushed polyester, polyester stitched loop, and loop material laminated to a different type of backing material. The foam backing may be a natural sponge material or polyurethane foam and the like. The foam backing also can be laminated to a different type of backing material. The mesh backings can be made of polymeric or metal open-weave scrims. Additionally, the backing may be a reinforced thermoplastic backing that is disclosed in U.S. Pat. No. 5,417,725 (Stout, et al.).

An additional benefit of the processes and constructions described in this invention is shape retention. After conventional converting processes, coated abrasive belts and disks may change shape or "cup" by as much as 2 inches (5 cm) depending upon the environment of storage conditions for these products. These types of changes are typically caused by the different web components in such products picking up environmental moisture or humidity at different rates. The present spiral process of this invention has flexibility to allow the moisture sensitive web components (typically paper) to be covered or protected from moist or humid air. For example, in one embodiment of this invention, a polyester film adhesive carrier also serves as a moisture barrier. The prevention of cupping over a wide range of relative humidity removes the necessity of further treating these types of products in order to meet acceptability requirements.

In one embodiment, the first web 50 is preferably a coated abrasive that may be formed from one or more layers of abrasive particles and one or more layers of backing material. In this embodiment, the second web 60 is preferably a splicing media formed from one or more layers of film coated on at least one side with an adhesive, such as an adhesive polymeric tape, or a coated fabric. The adhesive may be a pressure sensitive adhesive (PSA) requiring little or no processing after contact. Also, the adhesive may require thermal or radiation curing to fully complete adhesion between the webs 50, 60. The film may be a polymer film, such as a 0.0005 inch (12.7 micrometers) polyester film, or a fiber reinforced film.

In a second embodiment, the first web 50 is also preferably a coated abrasive. In this embodiment, the second web 60 is preferably a reinforcing backing, as described above, that may be attached to the first web 50 using, for example, a pressure-sensitive adhesive (PSA). The area of adhesive on the offset portion 66 may be applied to either the first or second webs 50, 60, respectively, after attachment of the second web 60 or may be applied during such attachment.

In the third embodiment, the first web 125 is also preferably a coated abrasive and the second web 130 is preferably a reinforcing backing; the third web 135 is preferably a splicing media, as described above for the first embodiment. Both the second and third webs 130, 135 may be attached to the first web 125 using one or more known techniques, with the adhesive on the offset portion 136 applied during or after attachment of the webs 130, 135.

In the fourth embodiment, the outermost web 160 may also be a coated abrasive, with the middle web 170 a reinforcing material and the innermost web 180 a splicing media or other suitable joining material. In one embodiment, the outermost web 160 may be the topmost layer of a coated abrasive, such as an abrasive coated backing material formed from a cloth or paper. However, the outermost web 160 may also include multiple layers of abrasive particles and/or multiple layers of backing material, if desired. In one embodiment, the innermost web 180 may be the lowermost layer of the coated abrasive, such as a reinforcing material, including a nonwoven or other suitable material that provides strength to the spiral belt 150 without providing a substantial increase in weight. In some embodiments, the innermost web 180 may be a hook-and-loop material, foam or other material described for use as a backing. Optionally, the innermost web 180 may also be multiple layers if desired.

In some embodiments, the middle web 170 is preferably an adhesive layer that joins the other layers of the coated abrasive forming the abrasive media 155. In one embodiment, the adhesive layer is formed from adhesive material coated onto both major surfaces of a film layer. For example, ethylene acrylic acid, available, for example, under the trade designation "SCOTCHPACK" from The 3M Company in St. Paul, Minn., is coated on both sides of a 0.0005 inch (12.7 micrometers) polyester film to form a total layer thickness of 0.0035 inch (88.9 micrometers). After the webs 160, 170, 180 are brought together, heat (at a temperature in the range of about 260°–270° F. (127°–132° C.) to achieve the cure temperature of the adhesive) and pressure are applied to the overlapped portions to activate crosslinking and bond the webs 160, 170, 180 together.

In another example, an ultraviolet (UV) curable resin is coated onto both major surfaces of a polyester film layer to form the middle web 170. One formulation of this resin includes 70 parts "EPON 828" (epoxy), 30 parts "HYTREL 6356" (polyester thermoplastic resin) commercially available from E.I. DuPont & Company and 1.5 parts "CYRACURE UVI-6974" (triarylsulfonium salt photocatalyst). The mixture is heated to 125°–130° C. before being applied to the film. In some embodiments, the adhesive is then preferably tackified with UV energy by passing it once beneath a 600 watt/inch (236 watt/cm) Fusion lamp using a D-bulb, medium pressure, mercury vapor lamp as described by Fusion Systems, Inc., Rockville, Md., just prior to winding of the spiral belt. Once the middle adhesive layer is tackified, the spiral belt 150 is formed from the three web layers 160, 170, 180. After belt formation, the belt 150 is heated for five minutes at 125° C. to complete the adhesive cure.

In yet another embodiment, the middle web 170 may be formed from an adhesive layer configured as a pre-cast film of adhesive material. Such adhesives may include "SURLYN," a Zn-modified ethylene/methacrylic acid copolymer by E.I. DuPont & Company of Wilmington, Del.

In the first embodiment, the coated abrasive first web 50 is formed in one or more processes, the second web 60 splicing media is coated with adhesive and attached to the first web 50 along an edge 52, 54 and then the combined abrasive media 80 is wound to form the spiral belt 100. In a similar manner in the second and third embodiment, the coated abrasive first web 50, 125 is formed in one or more processes, the second reinforcing web 60, 130 is formed in one or more processes, and then the second web 60, 130 is attached to the first web 50, 125. In the second embodiment, the combined abrasive media 80 is then spirally wound to form the belt 100. In the third embodiment, the third web 135 is formed in one or more processes, an adhesive is applied, and the third web 135 is attached to the first web 125. Afterward, the combined abrasive media 122 is spirally wound to form the belt 120. In the fourth embodiment, on the other hand, the formation of the abrasive media 155 preferably occurs simultaneously with the winding and formation of the spiral belt 150, thereby eliminating numerous processing steps, as well as the need for a splicing media, such as web 60 in the first embodiment or web 135 in the third embodiment. Such simultaneous formation also ensures both a good lamination of the abrasive media 155 and a strongly joined belt 150.

Figure 7:
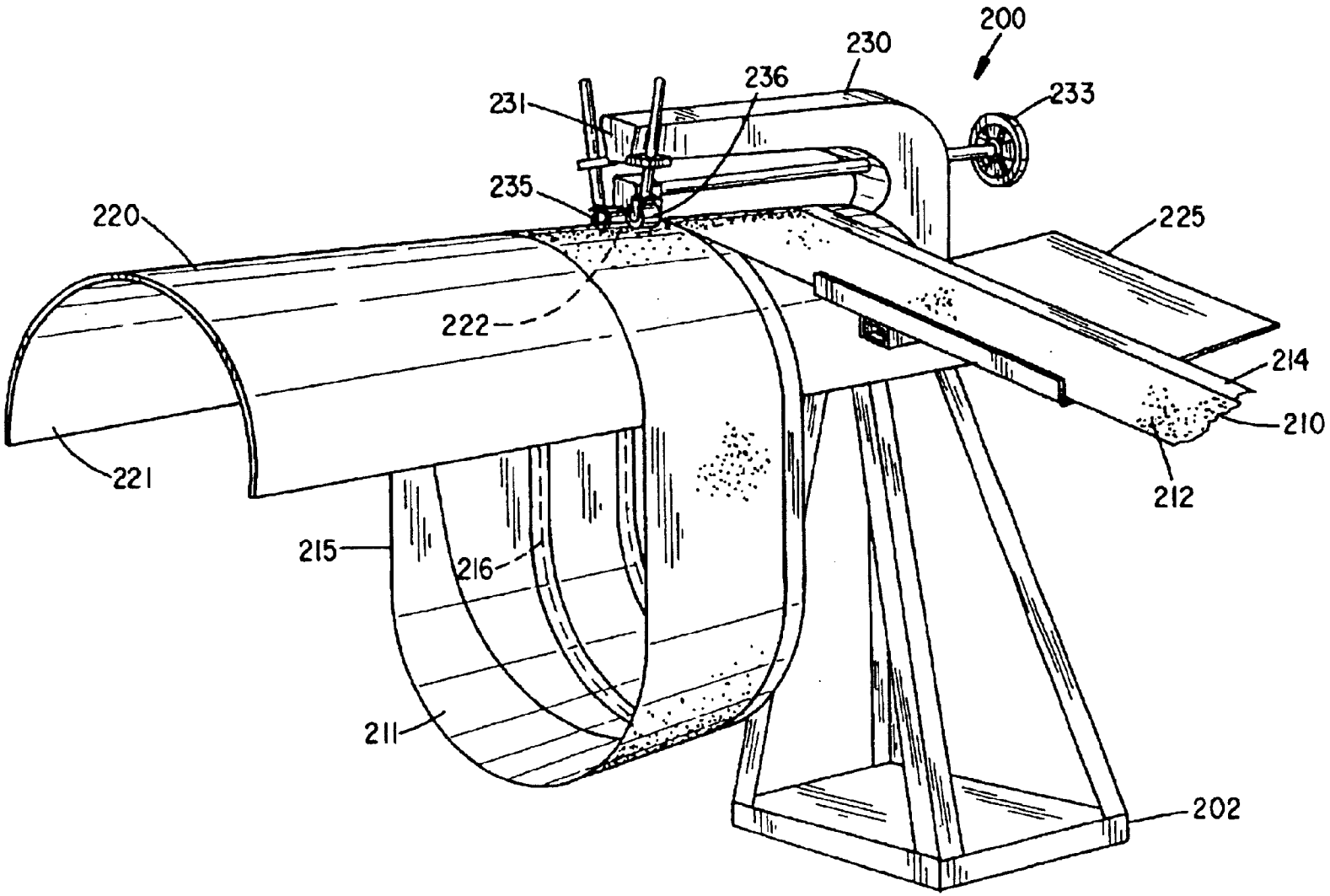
FIG. 7 is a perspective view of one embodiment of a spiral wound abrasive belt forming apparatus.
Figure 8:
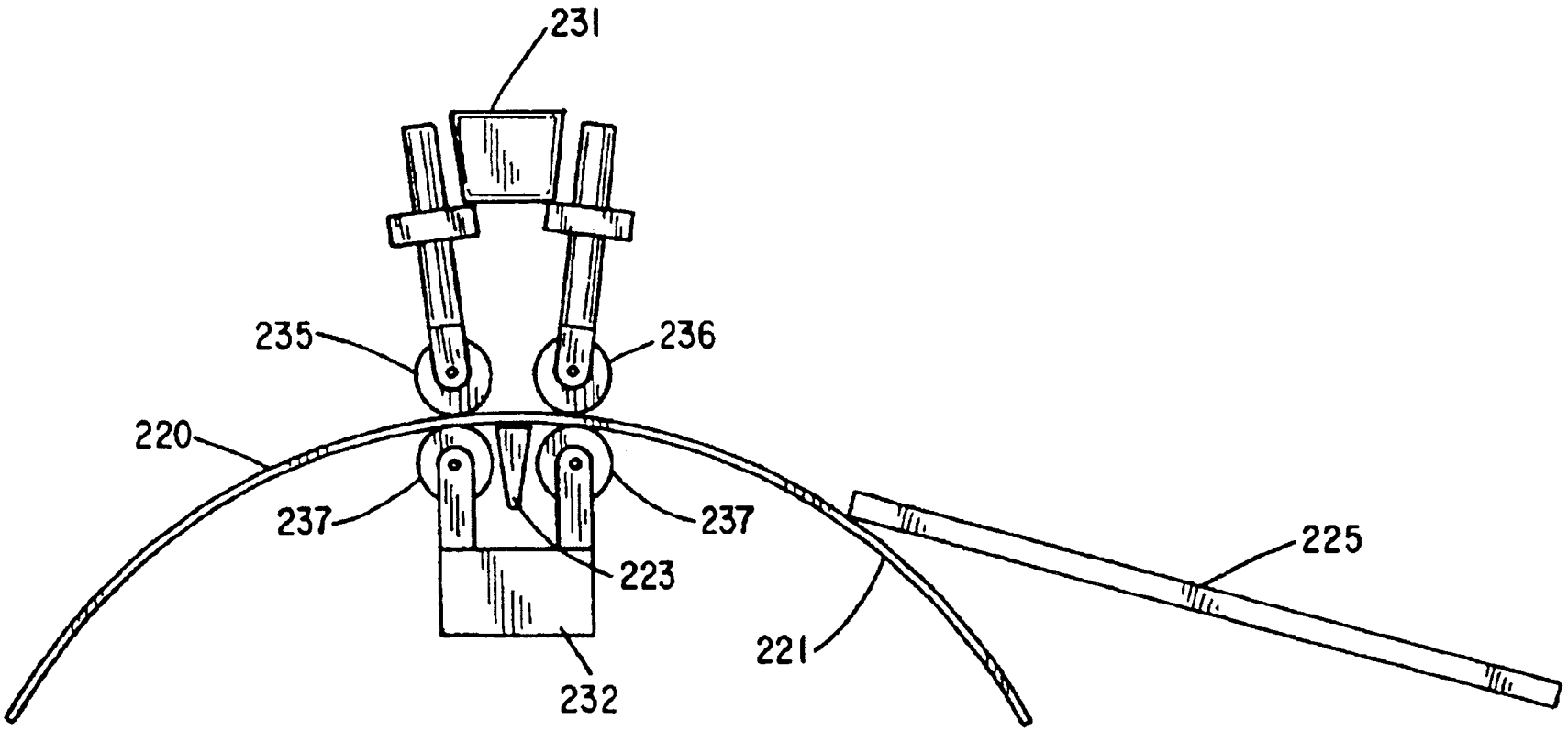
FIG. 8 is a partial end view of the apparatus of FIG. 7.

Formation of the spiral belt 100, 100', 120, 150 from the spiral wound abrasive media 80, 80', 122, 155 may be accomplished in numerous ways. FIGS. 7 and 8 show one embodiment of a spiral wound abrasive belt formation apparatus 200 configured to accept an input abrasive media 210 formed from a first web 212 and a second splicing web 214. The apparatus 200 includes a convexly curved hub 220 over which the abrasive media 210 is draped during the winding process. The hub 220 is supported by the apparatus 200 in a cantilevered manner to allow for continuous formation of a spiral belt 215 of ever increasing width having a spiral seam 216 formed where the edges of the first web 212 abut.

The apparatus 200 also includes a base 202 that supports the hub 220 and a "C" shaped arm 230. The arm 230 extends out both above and below a portion of the hub 220 and is mounted for pivotal movement with respect to the base 202. At the furthermost upper end 231 of the arm 230 two upper press rollers 235, 236 are mounted for pressure contact with two corresponding lower press rollers 237 that are mounted to furthermost lower end 232 of the arm 230. An opening 222 formed in the hub 220 adjacent the press rollers 235, 236, 237 allows for contact between the upper press rollers 235, 236 and lower press rollers 237. As the abrasive media 210 passes between the upper and lower press rollers 235, 236, 237, pressure is applied to both the upper and lower surfaces of the seam 216. Mounted on the underside 221 of the hub 220 adjacent the lower press rollers 237 is an optional heating element 223 positioned to radiate heat to the abrasive media 210. Optionally, a light source (not shown) may also be mounted on the underside 221 of the hub 220 at the opening 222 to shine up through seam 216 and thus aid in minimizing gaps at the seam.

One of the upper press rollers 235 is configured to be manually driven by rotary mechanism 233. As the abrasive media 210 is fed into the apparatus 200, the rotary mechanism 233 is turned to rotate the driven press roller 235 and thus pull the abrasive media 210 through the apparatus. In this embodiment, the remainder of the press rollers 236, 237 are not driven. Although configured with a manual drive, it is to be understood that the apparatus 200 may also be configured with a powered drive, with or without control.

The apparatus 200 also includes a guide tray 225. The guide tray 225 is adjustably mounted to support the input abrasive media 210 at a desired height and angle with respect to the hub 220.

Prior to input into the apparatus 200, the abrasive media 210 is constructed from webs 212 and 214. An angled leading edge or end 211 may be pre-cut into the abrasive media 210.

The apparatus 200 is then set up to form a spiral belt 215 having a desired width and circumference from pre-constructed abrasive media 210. The angle of the guide tray 225 with respect to the hub 220 establishes the angle at which the spiral belt 215 is wound and, thus, the size of the belt 215. Therefore during set up, the guide tray 225 is positioned at a desired angle with respect to the hub 220. The press rollers 235, 236, 237 facilitate joining of the first web 212 to the second web 214 by providing pressure to the abrasive media 210 as the seam 216 is formed. Therefore, during set up, the arm 230 is also pivoted to position the press rollers 235, 236, 237 at the desired angle to follow the abrasive media 210 as it is input from the guide tray 225. In addition, the pressure exerted by the upper press rollers 235, 236 against the lower press rollers 237 may be adjusted based on the requirements of the abrasive media 210 forming the spiral belt 215, and heat to soften or cure the adhesive may be supplied as needed from optional heater 223.

In operation, the abrasive media 210 is fed into the apparatus 200 along the guide tray 225 and over the hub 220. The leading end or edge 211 is wrapped around the hub 220 and is fed back into the apparatus 200 at the press rollers 235, 236, 237 to start formation of the seam 216 and, thus, the spiral belt 215. A first operator feeds the abrasive media 210 into the apparatus 200 while monitoring and attempting to minimize any gap at the seam 216. A second operator manually drives the driven press roller 235 using the rotating mechanism 233, thereby continuously feeding the abrasive media 210 into the apparatus and applying pressure at the press rollers 235, 236, 237 to the first web 212 as it overlaps the second web 214 at the seam 216 to bond the webs 212, 214 together. Heat may also be provided by the optional heater 223, if available and desired, to facilitate bonding of the webs 212, 214. The abrasive media 210 continues to be fed into the apparatus 200 and wrapped over the hub 220 forming the spiral belt 215 until a spiral belt 215 of desired width has been formed or until a second end (not shown) of the abrasive media 210 is reached. Once the spiral belt 215 is completed, tabs (such as tabs 109 in FIG. 1) may be applied to maintain adherence of the abrasive media 210 at both ends.

Figure 9:
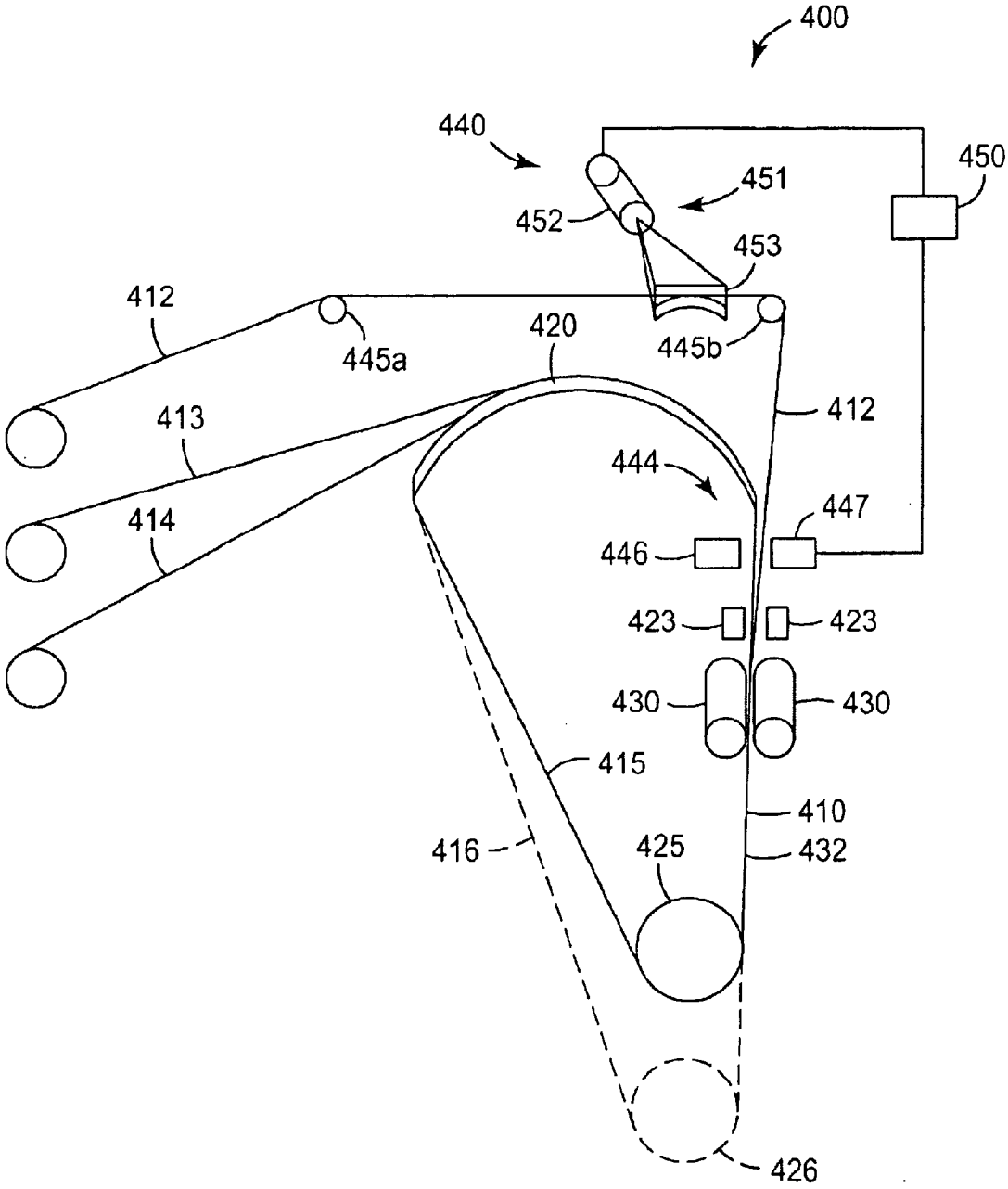
FIG. 9 is a diagram illustrating another embodiment of a spiral wound abrasive forming apparatus.

FIG. 9 is a diagram of one embodiment of a spiral wound abrasive belt winding apparatus 400 configured to accept a plurality of webs, such as webs 412, 413, 414, that simultaneously form an abrasive media 410 and a spiral belt 415. In some embodiments, each web 412, 413 and 414 preferably has first and second opposed major surfaces and elongated side edges. In some embodiments, outermost web 412 is preferably a coated abrasive, middle web 413 is preferably an adhesive layer, and innermost web 414 is preferably a reinforcing layer; however, other numbers and types of webs may also be used. The three webs 412, 413, 414 are wound over a stationary first hub 420 that is mounted in a cantilevered manner. A moveably mounted second hub or mandrel 425 provides tension for the spiral belt 415 and adjusts to accommodate spiral belts 415 of varying circumferences, as shown by phantom second hub 426 and belt 416. Second hub 425 may also be mounted in a cantilevered manner.

One advantage of the dual-hub system of the present invention is that it is much easier to provide tension for spiral belts 415 of varying circumferences by moving the second hub 425 relative to the first hub 420 than to change to the appropriately sized mandrel for each desired spiral belt circumference. The circumference of spiral belt 415 is infinitely adjustable to any suitable length. In one embodiment, spiral belt 415 has a circumference between about 10 inches (25.4 cm) and about 500 inches (1270 cm); more preferably, the circumference is between about 20 inches (50.8 cm) and about 200 inches (508 cm); and most preferably, the circumference is between about 103 inches (261.6 cm) and about 142 inches (360.7 cm). Another advantage of the dual-hub system is that the second hub 425 can be moved closer to the first hub 420 to release the tension and thereby facilitate removal of the spiral belt 415 from the two hubs 420/425. This is much easier than trying to remove a belt from a single mandrel about which it is tightly wrapped. While two hubs 420/425 are taught, with the first being stationary and the second being movable, it is contemplated that more than two hubs may be used, and any or all of them may be movable.

A web steering system including steering rollers 445*a* and 445*b* or other suitable devices may be included to control the presentation of one or more of the webs. In some embodiments, the webs 412, 413 and 414 are presented in a partially overlapping fashion, such that during winding of the spiral belt 415, each web's edges abut, preferably without appreciable gaps, forming three relatively continuous layers (see the fourth spiral belt embodiment in FIG. 6).

The splice angle of the spiral webs may be controlled by selecting different widths of the input rolls of the abrasive web or materials and/or different circumferences of the finished spiral wound abrasive article in order to provide preferred non-marking properties in some embodiments. For example, in a 52 inch (132.1 cm)×103 inch (261.6 cm) belt, the typical splice or wrapping angle (Angle 84 in FIG. 2) is about 71° when the splice is made with the use of conventional belt cutting devices and belt presses. With the spiral belt process of the present invention, and using a 12 inch (30.5 cm) wide input roll, the splice angle of the spiral wrap would be about 6.7°. Smaller splice angles are preferred by customers where splice marking and loading are generally the normal useful life endpoints of the abrasive belt.

For example, for a 52 inch (132 cm)×103 inch (262 cm) belt, the splice angle may be adjusted from about 3.9° to about 20.5° by varying the width of the input rolls from 7 inches (17.8 cm) to 36 inches (91.5 cm). As another example, using an input web with a width of 7 inches (17.8 cm), a finished belt with a circumferential length of 103 inches (262 cm) to 142 inches (361 cm) may have a splice angle from about 2.8° to about 3.9°. In some embodiments of the present invention, the splice or wrapping angle is preferably less than about 50°, more preferably less than about 30°, even more preferably less than about 20°, and most preferably less than about 6°.

In the embodiment illustrated in FIG. 9, a pair of driven nip rollers 430 drives the abrasive media 410 in a winding spiral to form the spiral belt 415 and applies pressure to the abrasive media 410 to assist adhesion between the webs 412, 413, 414. The position and angle of the nip rollers 430 with respect to the abrasive media 410 may be adjusted to accommodate changes in the abrasive media 410 due to adjustment of the second hub 425, adjustments of the input angle of the webs 412, 413, 414, or other factors. In one embodiment, first hub 420, nip rollers 430, and second hub 425 are preferably positioned so that the portion of spiral belt 415 passing from first hub 420, past nip rollers 430, and to second hub 425 is aligned substantially in a plane 432 (i.e., the outer edges of first hub 420 and second hub 425/426 are aligned substantially in a plane 432 with nip rollers 430). In one embodiment, these components are positioned so that plane 432 is substantially vertical.

Figure 10:
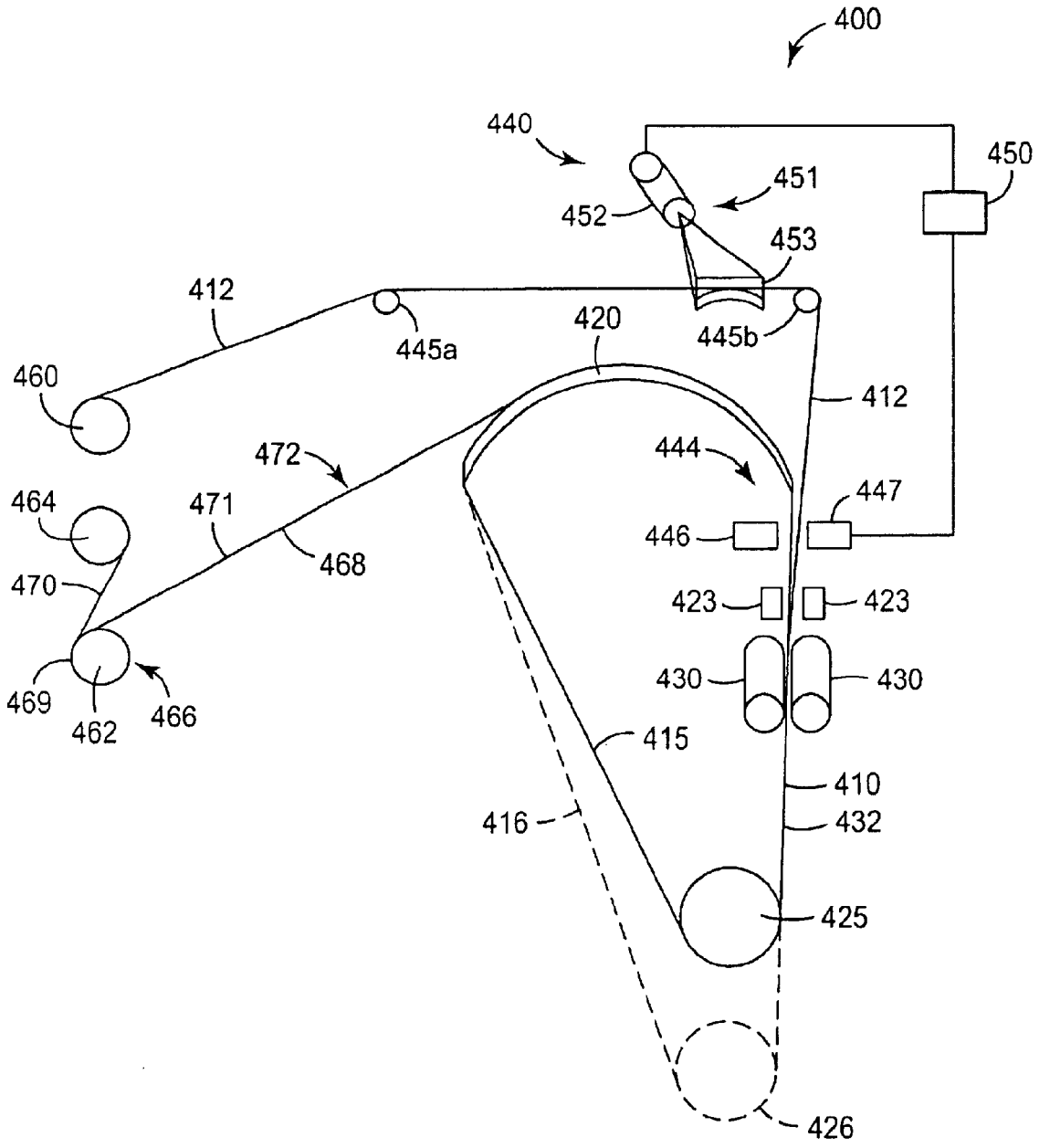
FIG. 10 is a diagram illustrating a method for forming an exemplary spiral wound abrasive using a forming apparatus.

Optional heating element 423 may be positioned to radiate heat to the abrasive media 410, thereby facilitating the bonding of webs 412, 413, 414. FIG. 10 shows an alternate location for the heating element 423, as compared to the location of heating element 223 shown in FIG. 8. In one embodiment, heating element 423 preferably comprises an infrared heater which heats both sides of abrasive media 410. When heating element 423 is placed in this position, it is advantageous for first hub 420, nip rollers 430, and second hub 425 to be positioned so that the portion of spiral belt 415 passing from first hub 420, past nip rollers 430, and to second hub 425 is aligned substantially in plane 432, as discussed above.

The process path includes plane 432 defined between first hub 420 and second hub 425/426. In one embodiment, one or both hubs 420 and 425/426 are preferably movable. However, even when the position of hub 420 and/or hub 425/426 is changed, the plane 432 is maintained and does not change position. Accordingly, endless abrasive media can be made having different media lengths (circumferences) on the same equipment, by modifying the relative positions of the hubs. The linear process path allows for better control of the manufacturing process. For example, heating element 423 can remain stationary, and web 410 will pass by heating element 423 at a position relative to nip rollers 430 regardless of the adjusted position of movably mounted second hub 425/426. Moreover, the linear process path allows for better product control during the manufacturing process.

Significant gaps or web overlap at the spiral seam (not shown) of the spiral belt 415 will cause surface marks and other surface non-conformities in an item ground or polished by the spiral belt 415 in a subsequent operation. Therefore, minimization of gaps or overlap is necessary to provide an acceptable spiral belt 415. The apparatus 400 includes on embodiment of a gap minimization system 440 to monitor the spiral seam and correct unacceptable seam separation.

The gap minimization system 440 includes a sensing mechanism 444 that uses a light source 446 positioned on the back side of the innermost web 414. The light source 446 may be visible light or may be infrared light, if desired. A light sensor 447 is positioned at the same point, but on the outside of outermost web 412. The light sensor 447 senses the amount of light shining through a possible gap at the seam of the outermost web 412. A controller 450 monitors the light sensor 447 and controls a positioning system 451 that adjusts the position of the outermost web 412 relative to the spiral belt 415 to close the gap. The positioning system 451 includes a positioning motor 452 connected to the controller 450 and a web movement mechanism 453 driven by the positioning motor 452. In order to better accommodate changes in the position of the outermost web 412, a steering roller 445*b* is included to route the outermost web 412 through the web movement mechanism 453. With such a gap minimization system 440, the light source 446 should be strong enough to pass a small amount of light through an optimized seam so that no light may be construed to be web overlap.

It is to be understood that other embodiments of a gap minimization system are possible and are within the spirit and scope of the present invention. For example, the visible light source 446 and light sensor 447 may be switched such that the light shines up through the abrasive media 410, thereby allowing an operator to monitor the light passing through the seam, as well. In addition, the web movement mechanism 453 may be only a push plate that can move the web in one direction toward the spiral belt. In this situation, the outermost web should be initially set up with a small amount of gap to allow for such unidirectional adjustment.

FIG. 10 is a diagram illustrating yet another embodiment of a spiral wound abrasive forming apparatus and a method for forming spiral wound abrasive article 415. FIG. 10 differs from FIG. 9 in that only two webs 412 and 468 are combined to define the spiral wound abrasive article 415. In some embodiments, each web 412 and 468 preferably has first and second opposed major surfaces and elongated side edges. First winder 460 carries outermost web 412, which in some embodiments is preferably of a coated abrasive material. Second winder 462 carries prelaminated adhesive core web 466.

Prelaminated adhesive core web 466 includes composite backing 468 and transfer tape 469. In some embodiments, a slip or antifriction agent is preferably applied to composite backing 468 on a major surface opposite transfer tape 469, as described by U.S. patent application Ser. No. 09/779,681 by Teetzel, entitled "Composition Containing Graphite," commonly assigned with the instant application to the 3M Innovative Properties Company and incorporated herein by reference. Transfer tape 469 includes liner 470 which carries adhesive 471. Liner 470 is releasably attached to adhesive layer 471 and is made from a material such as, for example, paper or polyethylene coated with a silicone or fluoropolymer resin. As prelaminated adhesive core web 466 is unwound from winder 462, liner 470 of transfer tape 469 is removed, leaving adhesive 471 on a major surface of composite backing 468. Liner 470 is wound onto winder 464 for ease of disposal. The combination of adhesive 471 and composite backing 468 defines an adhesive composite web 472. In one embodiment, prelaminated adhesive core web 466 is preferably about 0.178 meter (7 inches) in width.

In some embodiments, adhesive composite web 472 is preferably pulled toward first hub 420 for joining with outermost web 412. Simultaneously, first web 412 was unwound from first winder 460 and guided over first steering roller 445*a*, through web controller 453, and over second steering roller 445*b* and, at an offset of approximately 2 inches (5 cm), laminated to adhesive composite web 472 at nip rollers 430 to form abrasive media 410 having a 2 inch (5 cm) seam of adhesive layer 471 exposed. Abrasive media 410 are then successively wound around second hub 425 and first hub 420 to form helical belt 415. In other respects, spiral wound abrasive article 415 may be formed as described with respect to FIG. 9, but only two webs (412 and 468), rather than three (412, 413, 414), are processed.

Figure 11:
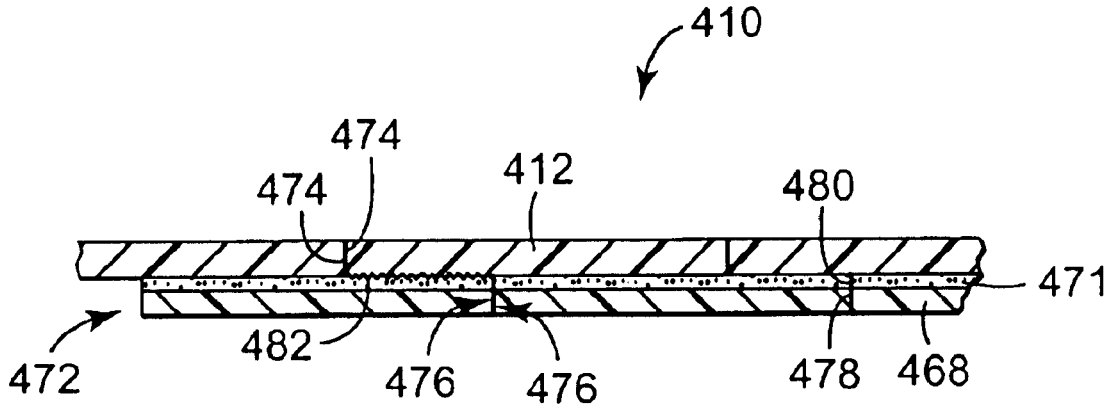
FIG. 11 is a partial cross-sectional view of a fifth embodiment of a spiral wound abrasive belt formed from an abrasive media including two webs.

FIG. 11 is a partial cross-sectional view of a fifth embodiment of abrasive media 410 formed from an abrasive media including two webs, using for example, the method discussed with reference to FIG. 10. Each turn of web 412 abuts the adjacent edge 474 of web 412 with no appreciable gap. The seam between web edges 474 is adhered together by overlap of adhesive composite web 472. In some embodiments, adhesive 471 preferably covers an entire major surface of composite backing 468, such that edges 478 of composite backing web 468 are co-linear with edges 480 of adhesive 471, thereby forming an edge 476 of adhesive composite web 472. In one embodiment, web 412 and adhesive composite web 472 have the same width, the overlap 482 between web 412 and adhesive composite web 472 is between about ¼ and about ½ of the width of each web, and each turn of adhesive composite web 472 abuts the adjacent edge 476 of adhesive composite web 472 with no appreciable gap.

In one embodiment, prelaminated adhesive composite web 472 is formed by applying transfer tape 469 (shown in FIG. 12), to composite backing web 468. Transfer tape 469 includes adhesive 471 and liner 470 and can be, for example, a transfer tape such as a tape commercially available from the 3M Company under the trade designation "467MP." Liner 470 is removed in the process described with reference to FIG. 10, leaving adhesive 471 on composite backing web 468, resulting in adhesive composite web 472 which is then adhered to outermost web 412. In one embodiment, adhesive 471 comprises a film coated with adhesive on both sides. One side of adhesive film 471 is prelaminated to composite backing web 468 and the other side of adhesive film 471 adheres to liner 470, which is removed in the process described above, resulting in adhesive composite web 472 which is then adhered to outermost web 412.

In one embodiment, outermost web 412 preferably comprises a coated abrasive including a backing layer of paper, textile, or polymeric material; a binder of thermally curable resinous adhesives, such as phenolic resins, epoxy resins, acrylate resins, acrylic lattices, lattices, urethane resins, glue, starch and combinations thereof, and abrasive particles of flint, garnet, aluminum oxide, alumina zirconia, ceramic aluminum oxide, diamond, silicon carbide, seeded or unseeded sol-gel alumina and the like. In some embodiments, a backing of polyester film is preferably coated with iron seeded sintered sol-gel alumina abrasive particles in a phenol-formaldehyde binder and having a phenol-formaldehyde size layer with calcium carbonate as a filler.

In some embodiments, adhesive composite web 472 preferably comprises backing material 468 of paper, textile, or polymeric material; coated or otherwise provided with a layer of adhesive 471 such as a phenolic resin, aminoplast resin, hot melt resin, latex resin, epoxy resin, ethylene acrylic acid resin, polyvinyl acetate resin, radiation curable resin, urea-aldehyde resin, urethane resin, polyurethane resin, acrylate resin, butadiene or butadiene styrene resin, acrylic polymer or copolymer, urethane-acrylic copolymer, vinyl either monomer and oligomer, or pressure sensitive adhesive. In one embodiment, composite backing 468 is preferably formed from 250 gram/$m^2$ cylinder paper and 28 gram/$m^2$ non-woven polyester laminated together with "SURLYN" copolymer adhesive. In one embodiment, adhesive transfer tape 469 is preferably obtained from the 3M Company under the trade designation "467MP." In one embodiment, adhesive transfer tape 469 is preferably laminated to the paper side of composite backing 468 and a graphite slip coating is preferably applied to the nonwoven side of composite backing 468.

Figure 12:
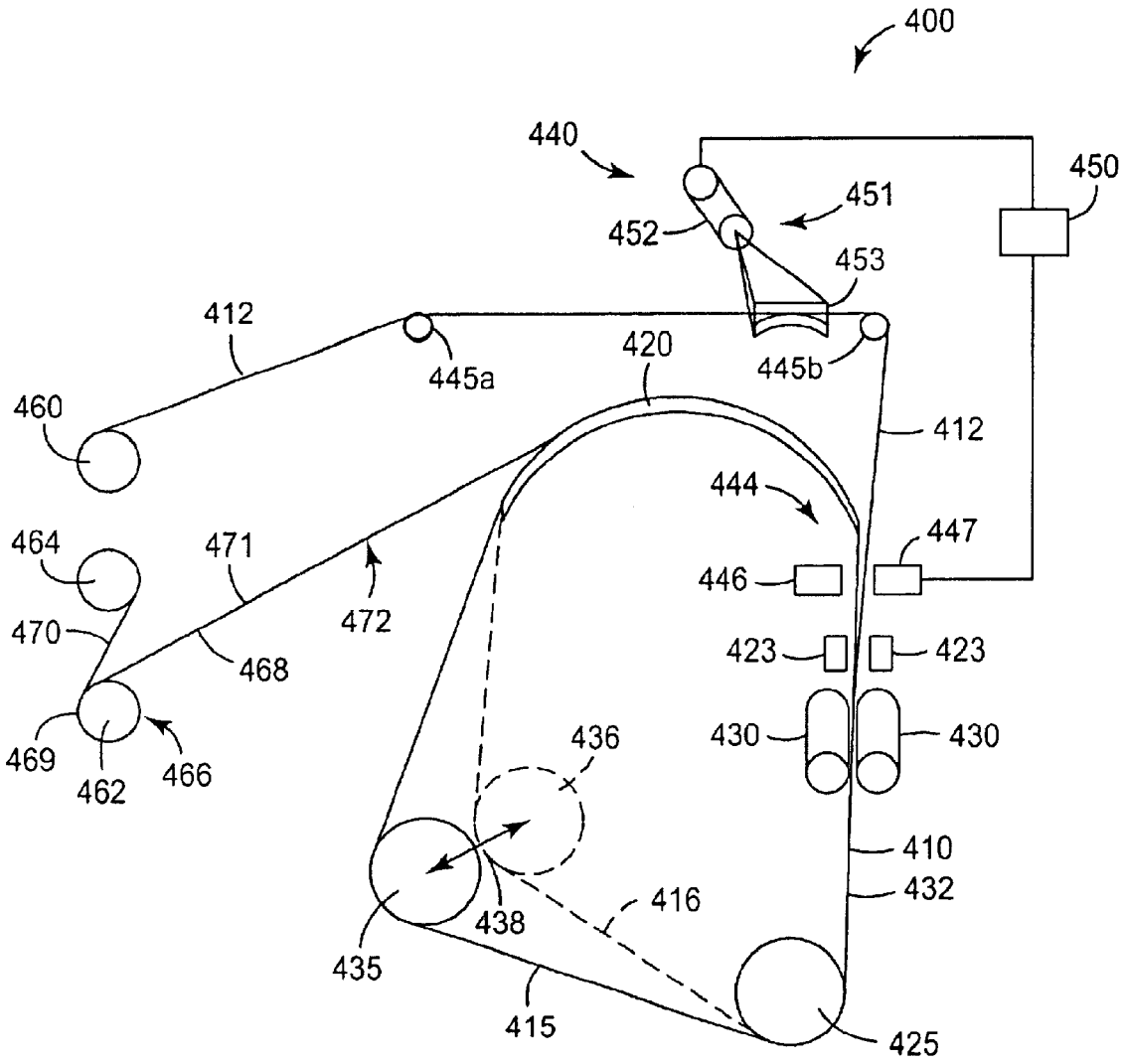
FIG. 12 is a diagram illustrating yet another embodiment of a spiral wound abrasive forming apparatus.

FIG. 12 is a diagram illustrating yet another embodiment of a spiral wound abrasive forming apparatus. FIG. 12 differs from FIG. 10 in that second hub 425 may remain stationary, and the position of a movably mounted third hub or mandrel 435 may instead be changed to vary the length of the process path and, as a result, the length of the circumference of the spiral belt 415 (see, e.g., longer phantom spiral belt 416). In one embodiment, third hub 435 is preferably movable to different positions along direction 438, between, for example, the positions illustrated for third hub 435 and phantom third hub 436. While movement of third hub 435 allows changes in the circumference of the spiral belt being formed, the linear portion 432 of the process path is unaffected.

In some embodiments, the abrasive web may, for example, be formed by applying a slurry of abrasive particles in a binder precursor that is subsequently cured to form the binder. Such slurries of abrasive particles in a binder precursor and techniques for applying them are well known in the abrasive art. In some embodiments, the abrasive media may, for example, be applied to the outer major surface of the spiral wound belt.

The present invention provides a spiral wound abrasive belt that may be formed in a continuous manner, may be formed in varying circumferences, and may be slit to a large range of widths, as needed. The spiral belt may be constructed from abrasive media whose edges are joined together along a spiral seam, or may be constructed from individual webs that simultaneously form the abrasive media and the spiral belt. The webs used to construct the spiral belt may be chosen to optimize the strength and durability of the belt, thus producing abrasive belts with significantly longer lives, while minimizing the weight and other belt characteristics that impact installation and use of the belt in subsequent abrasive applications.

The method of forming spiral wound abrasive belts and the apparatuses for practicing these methods in accordance with the present invention result in reduced labor and material costs. The methods and machines eliminate the need for multiple splices and custom sized equipment to form belts having the necessary circumference and width for a specific application. In addition, the offset layer process and equipment eliminate the need for additional joining material and allow for the inclusion of all layers of the abrasive media into the spiral belt construction.

Although the present invention has been described with reference to preferred embodiments, workers skilled in the art will recognize that changes may be made in form and detail without departing from the spirit and scope of the invention.

What is claimed is:

1. A method for forming a spiral wound endless abrasive article comprising:

providing a first elongate web having first and second opposed major surfaces and elongated side edges;

providing a second elongate web having first and second opposed major surfaces and elongated side edges, the second elongate web having an adhesive disposed on the first major surface, the second elongate web further having a liner layer releasably affixed to the adhesive;

removing the liner layer from the second elongate web;

positioning the second elongate web adjacent the first elongate web in a configuration offset from at least one of the side edges of the first elongate web;

providing first and second spaced apart hubs; and winding the first and second elongate webs in a spiral manner around the first and second hubs while abutting the side edges of the first elongate web and joining the abutted side edges of the first elongate web by overlap of the second elongate web to form an endless spiral wound article.

2. The method of claim 1 further comprising:

providing a driving mechanism intermediate the first hub and the second hub.

3. The method of claim 2, further comprising applying pressure to the endless spiral wound article as it is wound around the first and second hubs.

4. The method of claim 2 wherein a portion of the first and second webs passing from the first hub to the second hub via the driving mechanism is oriented substantially in a stationary plane.

5. The method of claim 4 further comprising:

varying a position of the second hub to thereby vary a circumference of the spiral wound abrasive article, wherein varying of the position of the second hub does not change the plane.

6. The method of claim 1 further comprising:

winding the liner layer about a winder.

7. The method of claim 1 further comprising:

changing a spacing between the first hub and the second hub to thereby vary a circumference of the spiral wound abrasive article.

8. The method of claim 7 wherein changing the spacing comprises moving a position of the second hub.

9. The method of claim 1, further comprising joining the first and second elongate webs after positioning the second elongate web adjacent to the first elongate web.

10. An endless spiral wound abrasive article comprising:

at least one first elongate web including first and second opposed major surfaces and having elongated side edges, wherein the first elongate web comprises a coated abrasive including at least one layer of abrasive particles on the first major surface; and at least one second elongate web including first and second opposed major surfaces and having elongated side edges, the first major surface of the second elongate web positioned adjacent the second major surface of the first elongate web but offset from at least one of the side edges of the first elongate web, the second elongate web configured to adhere at least in part to the second major surface of the first elongate web along one of the side edges of the first elongate web, the second elongate web further comprising a slip layer applied to the second major surface of the second elongate web, the first and second elongate webs wound at an angle of wrap of less than about 60° in a spiral configuration to form an endless spiral wound article, wherein the side edges of the first elongate web abut and are joined by the second elongate web overlapping the abutted side edges of the first elongate web.

11. An endless spiral wound abrasive article comprising:

at least one first elongate web including first and second opposed major surfaces and having elongated side edges, wherein the first elongate web comprises a coated abrasive including at least one layer of abrasive particles on the first major surfacer;

at least one second elongated web including first and second opposed major surfaces and having elongated side edges, the first major surface of the second elongate web positioned adjacent to the second major surface of the first elongate web but offset from at least one of the side edges of the first elongate web; the second elongate web comprising an adhesive layer comprising an adhesive material chosen from the group consisting of thermoplastics, urethanes, epoxies, ethyleneacrylic acids, radiation curable resins, pressure sensitive adhesives, latex, polyvinylacetate, polyvinylacrylic acids and combinations thereof; the second elongate web configured to adhere at least in part to the second major surface of the first elongate web along one of the side edges of the first elongate web;

the first and second elongate webs wound at an angle of wrap of less than about 6 in a spiral configuration to form an endless spiral wound article, wherein the side edges of the first elongate web abut and are joined by the second elongate web overlapping the abutted side edges of the first elongate web; and a third elongate web including first and second major surfaces and having elongated side edges; the third elongate web comprising a reinforcing layer comprising a reinforcing material chosen from the group consisting of woven, nonwoven and film materials; the third elongate web positioned adjacent to the second elongate web but offset from at least one of the side edges of the second elongate web, with the second elongate web further configured to adhere at least in part to one of the major surfaces of the third elongate web, the third elongate web further comprising a slip layer applied to a major surface of the third elongate web;

the third elongate web wound at an angle in a spiral configuration along with the first and second elongate webs to form the endless spiral wound article, wherein the side edges of the third elongate web also abut and are joined by the second elongate web overlapping the abutted side edges of the third elongate web.

12. A method for forming a spiral wound endless abrasive article comprising:

providing a first elongate web having first and second opposed major surfaces and elongated side edges;

providing a second elongate web having first and second opposed major surfaces and elongated side edges; the second elongate web having an adhesive disposed on the first major surface; the second elongate web further having a liner layer releasably affixed to the adhesive;

removing the liner layer from the second elongate web;

positioning the second elongate web adjacent the first elongate web in a configuration offset from at least one of the side edges of the first elongate web; and adhering the first web to the second web while winding the first and second elongate webs in a spiral manner while abutting the side edges of the first elongate web and joining the abutted side edges of the first elongate web by overlap of the second elongate web to form an endless spiral wound article.

13. The method of claim 12, further comprising applying pressure to the first and second webs as they are wound in a spiral manner.

14. The method of claim 12 wherein the first elongate web is a coated abrasive.

15. The method of claim 12 wherein the adhesive of the second elongate web is disposed on the entire first major surface of the second elongate web.

16. The method of claim 12 wherein providing the second elongate web comprises:

providing a film layer having first and second opposed major surfaces and elongated side edges, the film layer having adhesive disposed on the first and second major surfaces thereof; and laminating the second major surface of the film layer to the first major surface of the second elongate web.

17. The method of claim 16 wherein the liner is releasably affixed to the first major surface of the film layer.

18. The method of claim 12 wherein providing the second elongate web comprises:

providing an adhesive transfer tape having first and second opposed major surfaces and elongated side edges, the tape comprising a liner layer at the first major surface thereof and an adhesive layer at the second major surface thereof; and laminating the second major surface of the tape to the first major surface of the second elongate web.

19. The method of claim 18 wherein the elongated side edges of the adhesive transfer tape are colinear with the elongated side edges of the second elongate web.

20. The method of claim 18 further comprising a slip layer applied to the second major surface of the second elongate web.

* * * * *

UNITED STATES PATENT AND TRADEMARK OFFICE

CERTIFICATE OF CORRECTION

PATENT NO. : 6,805,722 B2
DATED : October 19, 2004
INVENTOR(S) : Hunt, Douglas C.

It is certified that error appears in the above-identified patent and that said Letters Patent is hereby corrected as shown below:

Column 2,
Lines 58-60, delete "FIG. 12 is a diagram illustrating yet another embodiment of a spiral wound abrasive forming apparatus." and insert the same on line 59.

Column 5,
Line 49, after "2,2-bis" delete "[4(2,3" and insert -- [4-(2,3 --.

Column 6,
Line 49, delete ""SURLYN."" and insert -- "SURLYN". --.

Column 8,
Line 22, delete "yams" and insert -- yarns --.

Column 9,
Line 16, delete "pressure-sensitive" and insert -- pressure sensitive --.

Column 15,
Line 43, after "thereof" delete "," and insert -- ; --.

Coluimn 17,
Line 31, after "moving" delete "a position of".
Line 44, after "adjacent" insert -- to --.
Line 55, delete "60°" and insert -- 6° --.
Line 65, delete "surfacer" and insert -- surface --.
Line 66, delete "elongated" and insert -- elongate --.

UNITED STATES PATENT AND TRADEMARK OFFICE

CERTIFICATE OF CORRECTION

PATENT NO. : 6,805,722 B2
DATED : October 19, 2004
INVENTOR(S) : Hunt, Douglas C.

It is certified that error appears in the above-identified patent and that said Letters Patent is hereby corrected as shown below:

Column 18,
Line 15, delete "6" and insert -- 6° --.

Signed and Sealed this

Twenty-eighth Day of March, 2006

JON W. DUDAS
*Director of the United States Patent and Trademark Office*